US005088473A

United States Patent [19]

Chen, deceased et al.

[11] Patent Number: 5,088,473

[45] Date of Patent: Feb. 18, 1992

[54] CHAIR HAVING ALIGNED MOVEMENT WITH CURVILINEAR-CIRCULAR, SWIVEL-ROCK, AND VERTICAL MOTIONS

[76] Inventors: Jing-Qi Chen, deceased, late of Houston, Tex.; by Judy C. Huai-Xue Zhu, heir, 6225 Highway 6 S., Houston, Tex. 77083

[21] Appl. No.: 500,417

[22] Filed: Mar. 28, 1990

[51] Int. Cl.[5] ..... A61H 1/00

[52] U.S. Cl. ..... 128/25 R; 128/33; 272/18; 272/97; 272/144

[58] Field of Search ..... 272/16, 17, 18, 33 R, 272/36, 44, 65, 69, 70, 93, 97, 129, 130, 134, 144; 434/253; 128/24 R, 25 R, 33, 44–55

[56] References Cited

U.S. PATENT DOCUMENTS

| | | | |
|---|---|---|---|
| 1,733,919 | 10/1929 | Stout . | |
| 2,595,272 | 5/1952 | Kost . | |
| 3,374,782 | 3/1968 | Izzo . | |
| 3,581,739 | 6/1971 | Brandt . | |
| 3,667,453 | 6/1972 | Schenck et al. . | |
| 3,865,430 | 2/1975 | Tanus . | |
| 3,912,260 | 10/1975 | Rice . | |
| 3,923,300 | 12/1975 | Tanus . | |
| 4,061,137 | 12/1977 | Sandt . | |
| 4,369,969 | 1/1983 | Straub . | |
| 4,483,327 | 11/1984 | Graham et al. . | |
| 4,509,743 | 4/1985 | Lie . | |
| 4,711,447 | 12/1987 | Mansfield | 272/17 X |
| 4,856,771 | 8/1989 | Nelson et al. | 272/18 |
| 4,915,373 | 4/1990 | Walker | 272/97 X |

FOREIGN PATENT DOCUMENTS

| | | | |
|---|---|---|---|
| 338295 | 10/1989 | European Pat. Off. | 272/97 |

*Primary Examiner*—Robert Bahr
*Attorney, Agent, or Firm*—Marsteller & Ass.

[57] ABSTRACT

The hula chair includes an upper base (23) and an intermediate base (21). The bases (21 and 23) are linked together by the specially designed oversized universal joint which is combined by two components: the ring (16) and the plate/spacer (17). The plate/spacer (17) is connected to the upper base (23). The ring (16) is connected to the intermediate base (21) by the stud (19). The upper base (23), can swivel-rock individually from the intermediate base (21), because of a universal joint (16, 17, 19). Two sets of three cams (10*a*, 10*b*, 10*c* and 20*a*, 20*b*, 20*c*) are placed under the plate-spacer (17) and on the intermediate base (21). A block (6), which is positioned at the center of the intermediate base (21), can slide inside a slot (7). The crankshaft (9) goes through the block (6) and the intermediate base (21). Three arms (11*a*, 11*b*, 11*c*), can vertically slide on the top end of the crankshaft (9). Three rollers (12*a*, 12*b*, 12*c*), which are placed on the top support of the arms (13*a*, 13*b*, 13*c*), can roll on the surface of their relative cams (10*a*, 10*b*, 10*c*). The rollers (15*a*, 15*b*, 15*c*), which are placed on the bottom support of the arms (14*a*, 14*b*, 14*c*), can roll on the surface of their relative cams (20*a*, 20*b*, 20*c*). A cam (4) is built on the base stand (22), just beneath the slotted block (2). A slide (3) can slide inside the slot formed in slotted block (2). A roller (5) that is connected to one end of the slide (3) runs in or between the groove (4*g*) of the cam (4). The crankshaft (9) is fixed to the other end of the slide (3) opposite to the end having the roller (5).

28 Claims, 5 Drawing Sheets

E——F

CHAIR HAVING ALIGNED MOVEMENT WITH CURVILINEAR-CIRCULAR, SWIVEL-ROCK, AND VERTICAL MOTIONS

BACKGROUND OF THE INVENTION

1. Technical Field

The present invention relates to movable chairs and platforms, and more particularly to exercise devices for moving selected parts of a human body sitting in the chair.

2. Background Art

A unique mechanism has been designed concisely and ingeniously. The chair may optionally use only one crankshaft to produce an aligned movement with three types of motion. They are the curvilinear-circular, swivel-rock, and vertical motions These actions allow the body's waist, abdomen and buttocks to move just like the Hula Dance, (that is the reason it is called the Hula chair) which limbers up the whole body.

Schenck, U.S. Pat. No. 3,667,453, discloses a chair having a movable seat that reciprocates around a vertical axis relative to the chair for exercise purposes Unlike the present invention with movement in all three axes, the Schenck chair moves the seat in a single two-dimensional plane.

Kost, U.S. Pat. No. 2,595,272, develops three dimensional movement in the seat using a crankshaft mounting to the seat support suspended above a ball joint. The movement is restricted in one dimension through the anchoring effect of the ball joint, unlike the present invention.

Stout, U.S. Pat. No. 1,733,919, is another chair with a seating portion or base that moves. The movement in the Stout device is caused by a "bent" crankshaft attached to the seat base. As the crankshaft is turned, the seat is moved in a three-dimensional "zigzagp" pattern. The design does not control movement as disclosed in the present invention.

U.S. Pat. Nos. 3,374,782; 3,581,739; 3,865,430; 3,912,260; 3,923,300; 4,061,137; 4,369,969; 4,483,327; and, 4,509,743 disclose several other versions of movable chairs and other types of exercise machines. The movement in each is generally limited or the references do not disclose a chair.

DISCLOSURE OF INVENTION

A main object of this invention is to provide an improved chair or movable stationary base that may use only one crankshaft to produce an aligned movement with three types of motion.

The present invention generally comprises an upper base and a lower base. The bases are linked together by the specially designed oversized universal joint which is combined by two components: the ring and the plate/-spacer. The plate/spacer is connected to the upper base. The ring is connected to the lower base by a stud. The upper base, can swivel-rock individually from the lower base, because of a universal joint. Two sets of three concentric cams are placed under the plate-spacer and on the lower base. A block, which is positioned at the center of the lower base, can slide inside a slot. The crankshaft goes through the block and the lower base. Three generally T-shaped arms can slide vertically on the top end of the crankshaft. Three rollers are placed on the top support of the arms and can roll on the surface of their relative cams. The rollers, which are placed on the bottom support of the arms, can roll on the surface of their relative cams.

Other objects of the invention will be apparent from the specification when taken in conjunction with the accompanying drawings and the appended claims.

MODE(S) FOR CARRYING OUT THE INVENTION

So that the manner in which the above recited features, advantages and objects of the present invention are attained can be understood in detail, more particular description of the invention, briefly summarized above, may be had by reference to the embodiment thereof that is illustrated in the appended drawings. In all the drawings, identical numbers represent the same elements.

In general the present invention includes a chair having a seat portion and a back portion. A base means for supports the device above a selected surface. Closed horizontal loop means produce a controlled closed loop movement of an essentially perpendicular axis in a substantially horizontal plan. Vertically rising means furnish a controlled vertical movement Rocking means impart a selected rocking movement to the seat. First connecting means mechanically couple the closed loop means to the vertically rising means. Second connecting means also mechanically couple the vertically rising means to the rocking means. Motor means furnish the energy to drive the closed loop means through its rotation. This results in the activation of the motor means generating movement in the seat in essentially a horizontal plane, vertically, or a rocking motion, or any desired combination of the three separate movements.

I. Drive and Mechanism

Figure 1:
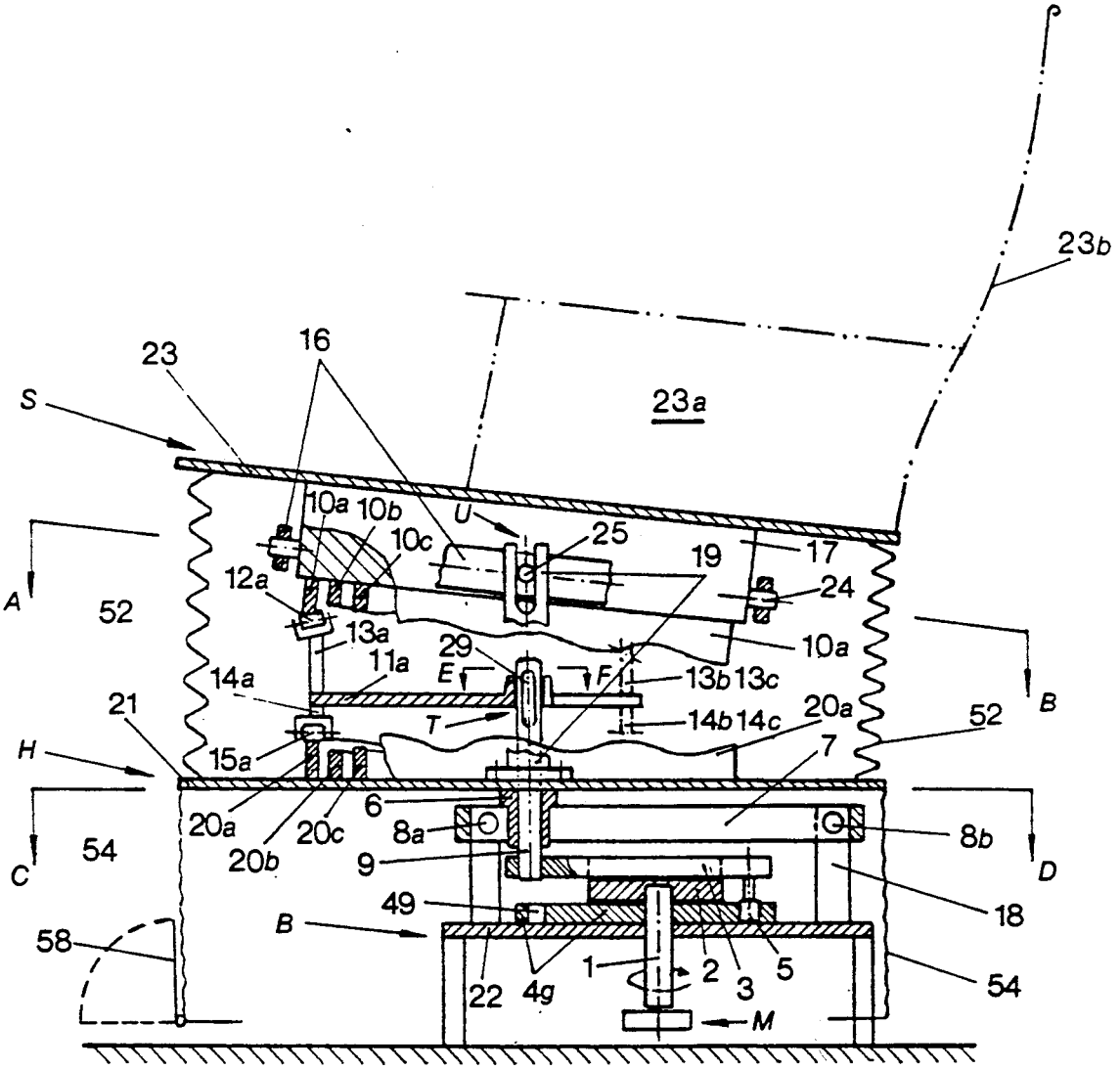
FIGS. 1 and 3 are side views of the present invention with certain elements cut-away for clarity.

A preferred embodiment of the hula chair or movable platform (H) is shown in FIG. 1. The chair generally consists of a seat (S) and an intermediate plate or base (21). They are linked together by the specially designed oversized universal joint (U) which consists of two components: the ring (16) and the plate/spacer (17). The plate/spacer (17) is connected to the upper base (23). The ring (16) is connected to the intermediate plate or base (21) by the stud or rod (19). The seat (S) generally comprises a chair like structure (23, 23*a* and 23*b*) or a platform or other support (23). The upper base (S), can swivel-rock individually from the intermediate plate (21) because of a universal joint (16, 17, 19).

A set of at least three cams (10*a*, 10*b*, 10*c*) is placed under a disk (17) that is a plate-spacer and is generally affixed to the lower side of the space (17). A block (6), which is positioned at or extends through the center of the intermediate base (21), can slide inside a track or slot (7). A crankshaft (9) goes through the block (6) and the intermediate base (21).

At least three arms (11*a*, 11*b*, 11*c*) are movably mounted to crankshaft (9) and can vertically slide on the top or upper end of the crankshaft (9). Three rollers (12*a*, 12*b*, 12*c*), which are affixed to the top supports (13*a*, 13*b*, 13*c*) extending upwardly from the outer end of the arms (11*a*, 11*b*, 11*c*, respectively), can roll on the surface of their relative cams (10*a*, 10*b*, 10*c*). The rollers (15*a*, 15*b*, 15*c*), which are placed on the bottom supports (14*a*, 14*b*, 14*c*, respectively) of the arms (11*a*, 11*b*, 11*c*), can roll on the surface of their relative cams (20*a*, 20*b*, 20*c*), which are placed on the intermediate base (21). Preferably, rollers (12*a–c* and 15*a–c*) and supports (13*a–c* and 14*a–c*) are aligned for maximum mechanical strength.

Figure 2:
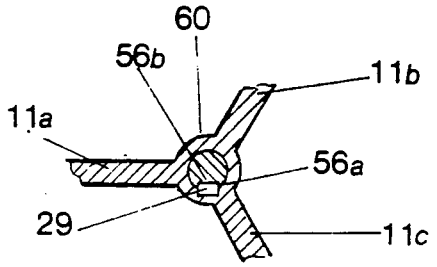
FIG. 2 is a detail view taken along line E—F of FIG. 3.
Figure 4:
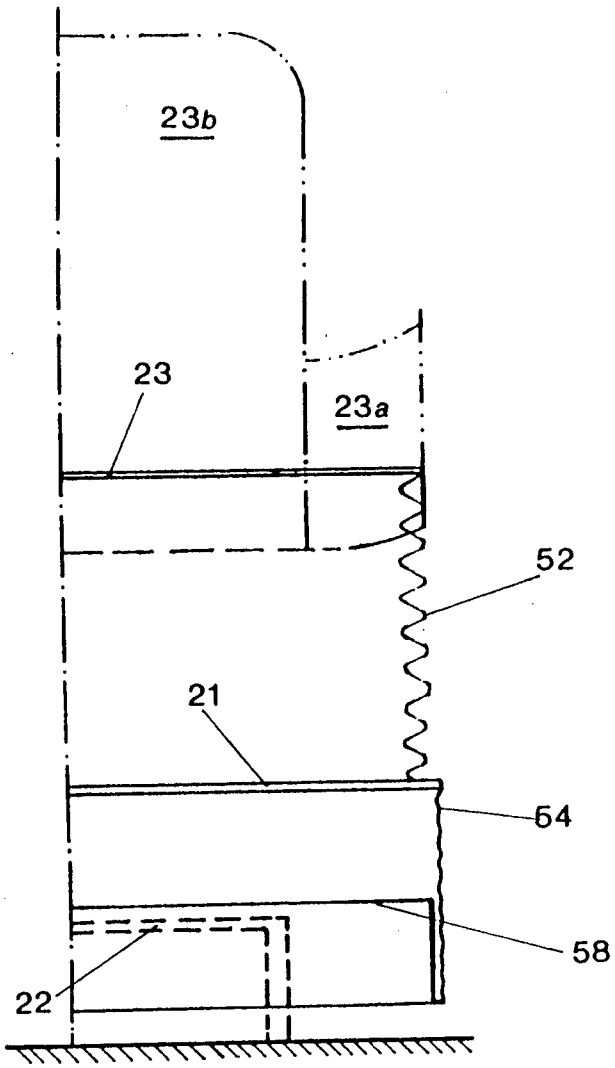
FIG. 4 is a frontal view.
Figure 3:
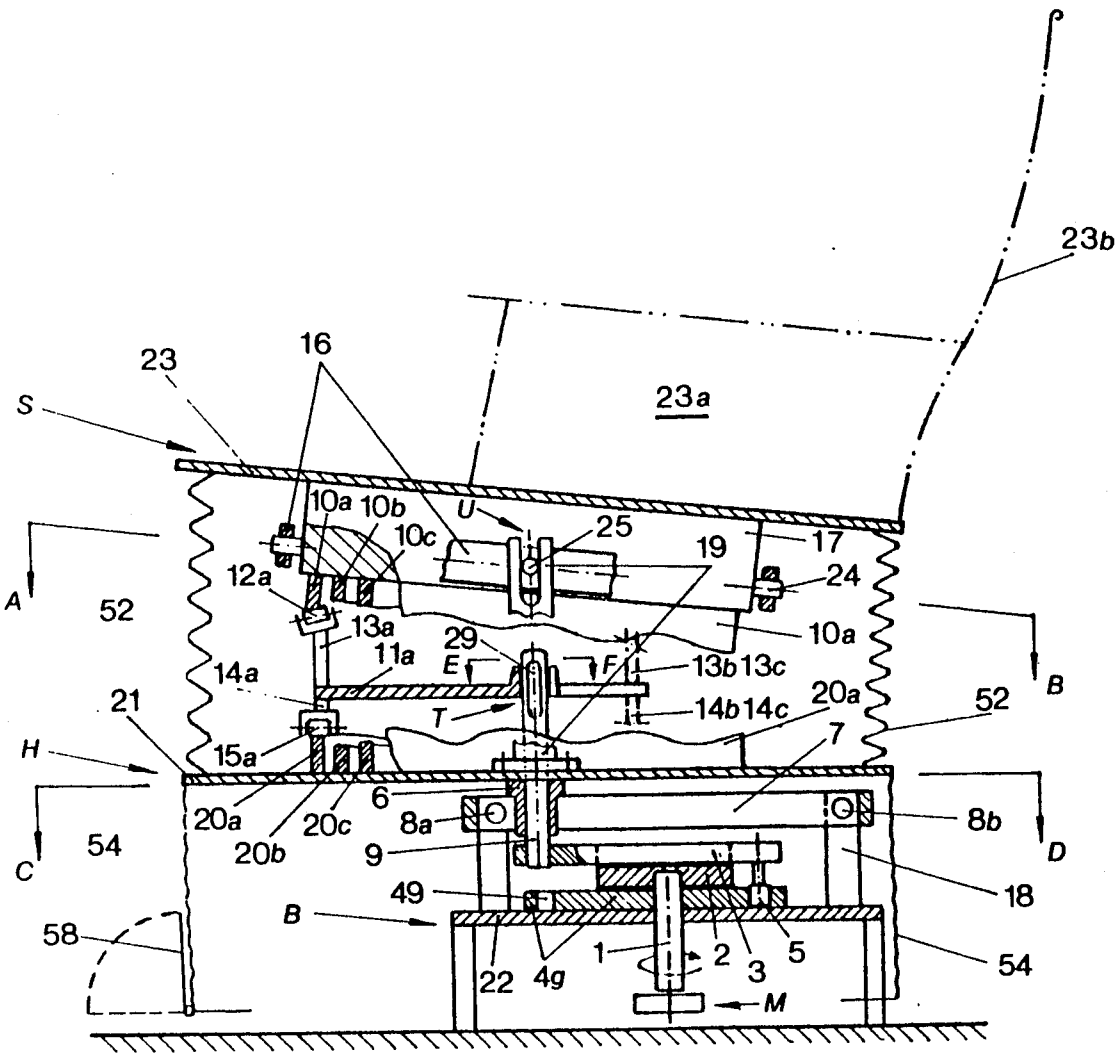
Figure 6:
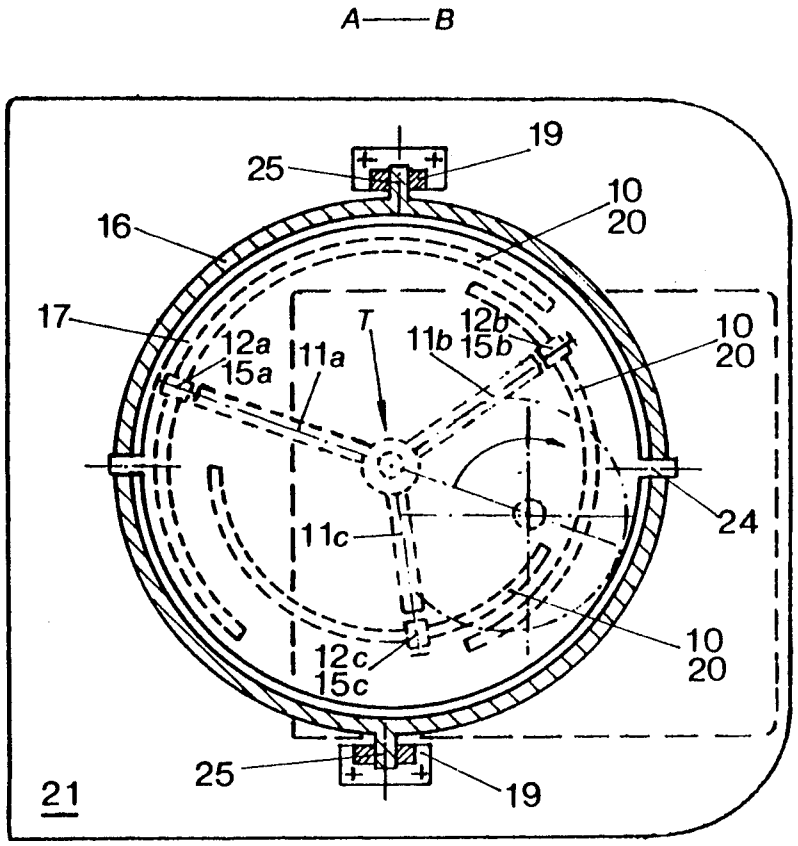
FIG. 6 is a cross-sectional view taken along line A–B of FIG. 3.

The arms (11*a–c*) are joined at a central hub (60) (see FIG. 2) forming a unit (T). The arms are equally spaced apart and radiate from the hub (60). As is shown in FIG. 6, the length of each arm, that is, the distance from the hub (60) to the respective junction of supports (13*a–c* and 14*a–c*) varies according to the diameters of the respective concentric cams (10*a–c* and 20*a–c*).

Figure 10:
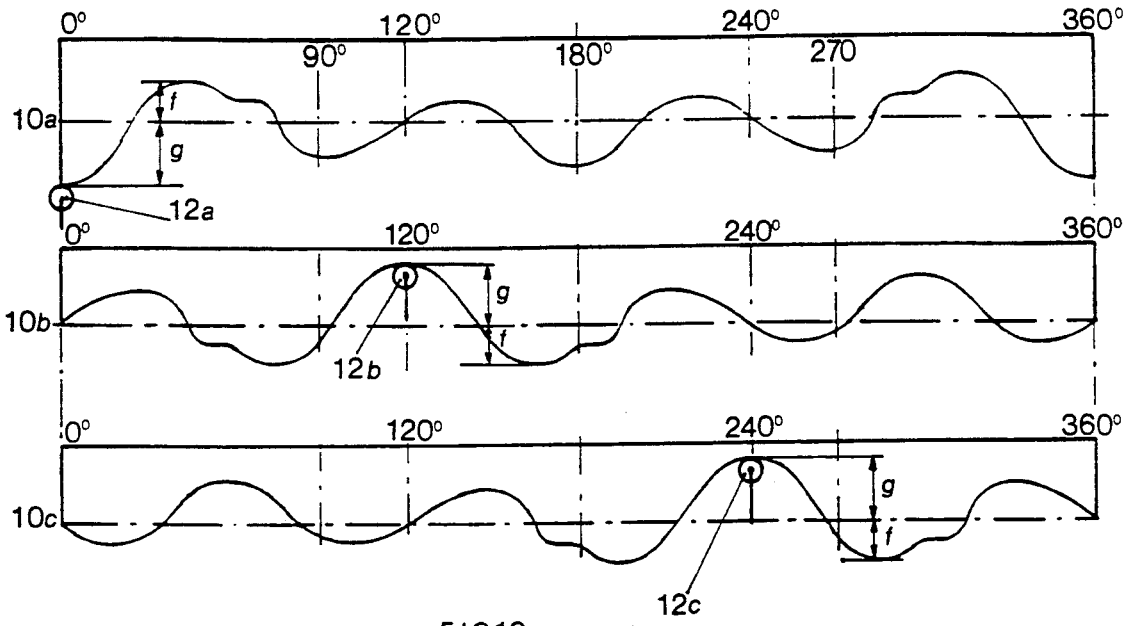
FIG. 10 is a sequence of charts showing the path of the rollers (12*a*, 12*b*, 12*c*) on upper cams (10*a*, 10*b*, 10*c*) in a corresponding configuration (as swivel-rock motion).
Figure 11:
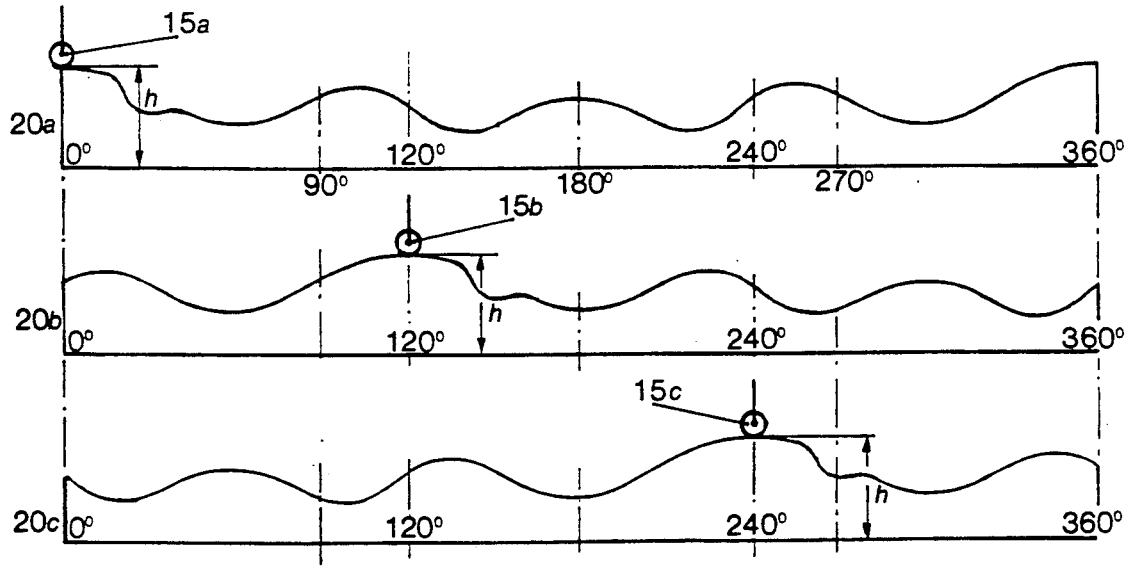
FIG. 11 is a sequence of charts showing the path of the rollers (15*a*, 15*b*, 15*c*) on lower cams (20 *a–c*) in a corresponding configuration (as vertical motion).
Figure 12:
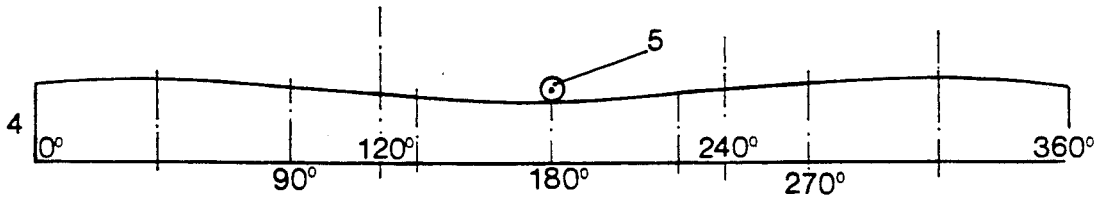
FIG. 12 shows the path of the roller (5) against cam (4) in a corresponding configuration (as curvilinear-circular motion).

Each of the sets of three or more cams generally comprises three concentric cylinders. Each cylinder (cam) has varying heights (see FIG. 10–11).

While the description of the present invention includes only three cams and arms, varying numbers can be selected to achieve the same purposes.

Aligned movement for purposes of the present inventions means that are orientation of the chair, which consists essentially of a seat (S) and intermediate plate or base (21), is restrained while the chair seat does the three types of motion. This allows the suer to sit in the chair, maintain their feet on the floor and not be moved from their generally forward facing orientation. In general, the orientation of the chair or the upper support structure remains essentially aligned facing a desired direction, that is, front.

Relative turning for purposes of the present invention means there is the relative turning point between the crankshaft (9) and block (6) while the crankshaft (9) drives or moves the block (6) in a fixed orientation movement. This also causes a relative movement between the cams (10*a–c* and 20*a–c*) and the arms (11*a–c*), and result in the chair having a swivel-rock ro vertical motion.

A. Curvilinear-Circular Motion

A cam (4) is built on the base stand (22), just underneath the slotted block (2). When the main-shaft (1) turns by means of motor (M), the slotted block (2), also turns, and so does the slide (3), which can slide inside the slot formed in slotted block (2) (shown from the top in FIG. 5 and cross-sectionally in phantom in FIG. 1). A roller or crankshaft pin (5), that is connected to one end of the slide (3) runs in or between the groove (4*g*) of the cam (4). All these actions will cause the crankshaft (9), which is fixed to the other end of the slide (3) opposite to the end having roller (5), to move in a curvilinear-circular motion as the main shaft (1) rotates or turns.

The motor (M) is preferably an electric motor directly connected to one end of main-shaft (1) or coupled to the main-shaft (1) through gears.

B. Aligned Movement

Figure 5:
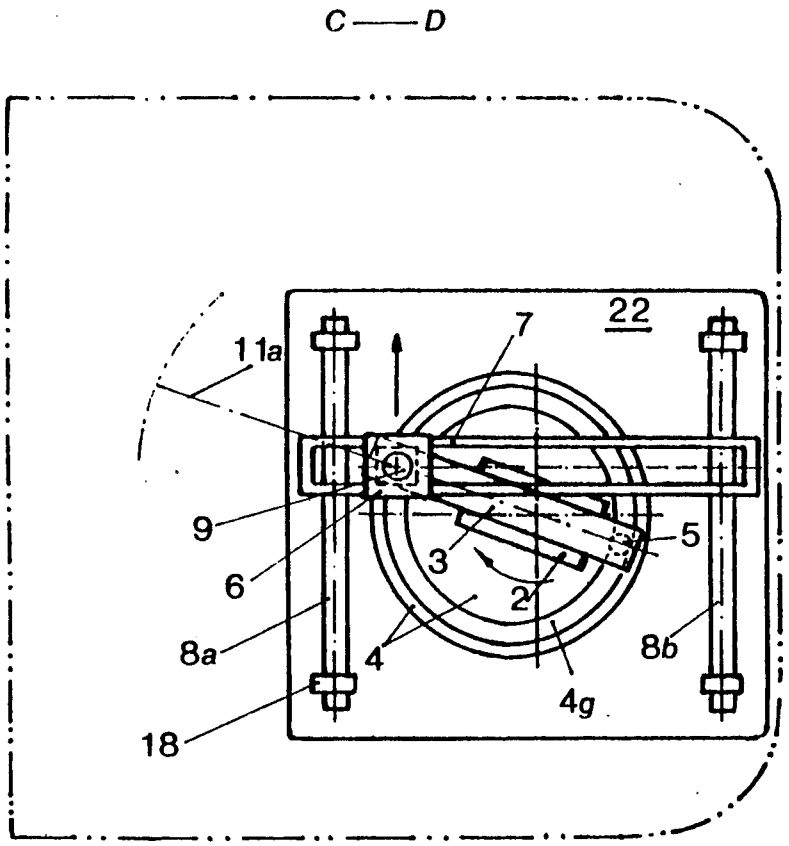
FIG. 5 is a cross-sectional view taken along line C–D of FIG. 3.

FIG. 5 shows that the orientation of the block (6) is restrained and can only slide left and right (relative direction depicted in FIG. 5) in the track or slot (7). The track (7) can only move up and down (relative direction depicted in FIG. 5) on the two parallel bars (8*a*) and (8*b*). In other words, the block (6) will keep an aligned movement or, in other words, the orientation of the block (6) does not rotate about its vertical axis. Also, the crankshaft (9) goes through the block (6), and the block (6) is locked to the intermediate base (21). As the crankshaft (9) turns around the main-shaft (1), the components: (21), (10*a*), (10*b*), (10*c*), (16), (17), and (23), will also move around it; but will keep an aligned movement. That is because of the restraining movement of the block (6) as explained above. The result is that the whole chair will ensure an aligned movement.

C. Swivel-Rock Motion

The crankshaft (9), goes through the block (6) and passes through the center hole of the intermediate base (21). The three arms (11*a*, 11*b*, 11*c*), can vertically slide on the top end of the crankshaft (9). The three rollers (12*a*, 12*b*, 12*c*), are positioned on their respective top supports (13*a*, 13*b*, 13*c*) of the arms. The block (6), intermediate base (21), and the cams (10*a*, 10*b*, 10*c*, 20*a*, 20*b*, 20*c*) are in an aligned movement, while the crankshaft(9) turns. Also the rollers (12*a*, 12*b*, 12*c*) will roll on their relative cams (10*a*, 10*b*, 10*c*). In other words there is a relative turning between the rollers (12*a*, 12*b*, 12*c*) and the cams (10*a*, 10*b*, 10*c*), while the main-shaft (1) turns. This relative turning action gives the upper base (23) and the whole chair a swivel-rock motion at different curves. This is because the three cams (10*a*, 10*b* 10*c*) and the support of the rollers (13*a*, 13*b*, 13*c*) are made of a specially designed curvature and size (see FIGS. 10, 1 and 6).

D. Vertical Motion

Cams (20*a*, 20*b* 20*c*) are located on the intermediate plate or base (21). The rollers (15*a*, 15*b*, 15*c*) are placed on the bottom supports (14*a*, 14*b*, 14*c*) of the arms and can roll on the surface of the cams (20*a*, 20*b*, 20*c*). The arms (11*a*, 11*b*, 11*c*) can vertically slide on the top end of the crankshaft (9). This is because a key (29) and key slot (56*a*, 56*b*) (FIG. 2), are placed between the crankshaft (9) and the arms. When the crankshaft (9) turns around the main-shaft (1) the arms (11*a*, 11*b*, 11*c*) have a vertical motion which follows the curves of the cam (20*a*, 20*b*, 20*c*). This also gives the cams (10*a*, 10*b*, 10*c*) and the upper base (23), a vertical motion, because they are linked to the arms (11*a*, 11*b*, 11*c*). This motion enhances the Hula chairs movements.

E. As on the above explanation, the crankshaft (9) can turn with a curvilinear-circular motion, which is controlled by the cam (4). It also goes through the center hole of the block (6) and intermediate base (21), which turns the arms (11*a*, 11*b*, 11*c*) and the rollers (12*a*, 12b, 12c) (the rollers can roll on the respective cams (10a, 10b, 10c)). This causes the swivel-rock motion, because there is a relative turning point between the rollers and the cams. For the same reason the rollers (15a, 15b, 15c) which are on the bottom supports (14a, 14b, 14c) of the arms, rolls on the cams (20a, 20b, 20c). The result is a vertical motion.

Combining the above three motion (curvilinear-circular, swivel-rock, and vertical motions) and the aligned movement, it will produce a unique chair or platform base with a hula dance style motion.

II. Usefulness and Functions

The user of the present invention can get a healthy and comfortable exercise without consuming body energy, because the mechanism work does everything.

A. Helps people on diet beautify their body. Specially ideal for assisting women to regain their shape after pregnancy.
B. Helps the digestive system to regulate itself.
C. Limbers up the joints.
D. Older age and handicap health care.
E. Exciting entertainment (if user speeds up the motions).

III. Detailed Description of the Best Mode

A. A uniquely designed mechanism that may optionally use only one crankshaft will produce an aligned movement with three types of motions (curvilinear-circular, swivel-rock, and vertical). This design reduces space to meet the need for the Hula chair.

B. Universal-joint (16, 17, 19)

To ensure the chair's stable swivel-rock motion, an over-sized universal-joint (16, 17, 19), can eliminate free-play at the 'x' and 'y' axis in a horizontal direction. The plate/spacer (17) is connected to the upper base (23). The ring (16) is connected to the intermediate base (21) by the stud (19). This U-joint gives enough room to place two sets of cams (10a, 10b, 10c and 20a, 20b, 20c) as the crankshaft goes through the intermediate base (21).

C. Swivel-Rock Motion

There are a set of cams (10a, 10b, 10c) that have different curves are mounted to the underside of the plate/spacer (17). Two pins (24) extend from the plate (17) on opposite sides and movably or pivotally mount the plate (17) to the ring (16). Three different lengths of strong arms (11a, 11b, 11c) can slide on the top end of the crankshaft (9). Three rollers (12a, 12b, 12c), (also, the roller support (13a) on the arm (11a) is higher than on the other two arms) are placed on the end of the arms (11a, 11b, 11c). While the crankshaft (9), with the three arms (11a, 11b, 11c) turns, the three rollers (12a, 12b, 12c) will roll on the surface of their relative cams (10a, 10b, 10c). This action causes the upper base (23), and the chair, to move in a swivel-rock motion.

D. Vertical Motion

Three cams (20a, 20b, 20c) are located on the intermediate base (21). Rollers (15a, 15b, 15c) are placed on the bottom supports (14a, 14b, 14c) of the arms, and can roll on the surface of the cams (20a, 20b, 20c). A key (29) and key slot (56a and 56b) are placed between the top of the crankshaft (9) and the arms. When the crankshaft (9) turns around the main-shaft (1), the arms (11a, 11b, 11c) have a vertical motion which follows the curve of the cams (20a, 20b, 20c), which are placed on the intermediate base (21). This vertical motion enhances the Hula chair's movements.

E. Vertical Cushioning Effect Unit

Figure 7:
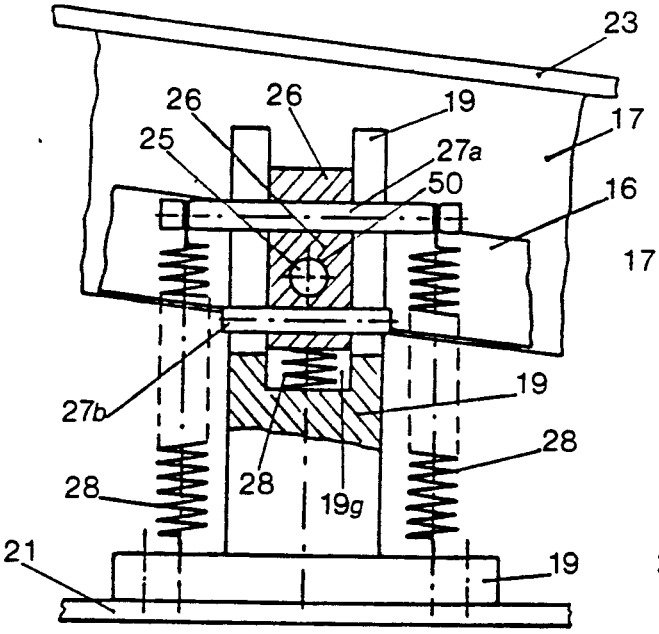
FIG. 7 is a cross-sectional detail drawing of the vertical cushioning effect unit of the present invention.
Figure 8:
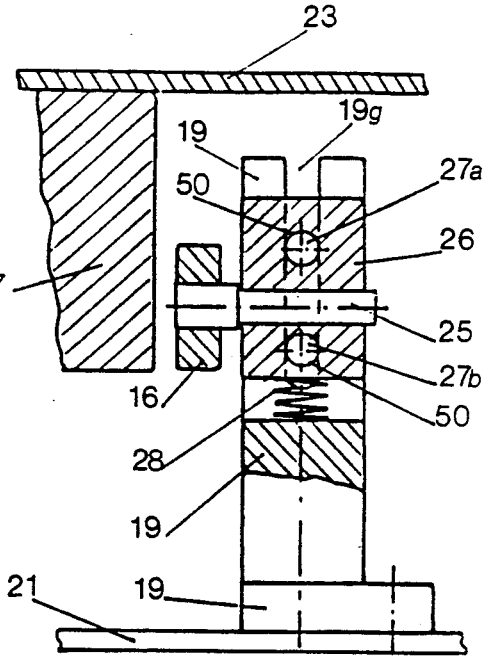
FIG. 8 is another cross-sectional detail drawing of the vertical cushioning effect unit taken at a ninety degrees from the view of FIG. 7.

The stud (19) has two intersecting grooves (19g) (as shown in FIGS. 7–8). An X or cross shaped block (26) can slide up and down in the intersecting grooves of the stud (19). The block (26) also has three holes (50) drilled through it. The middle hole is positioned at a right angle to the top and bottom holes. (As shown in FIGS. 7–8). The shaft (25) on the ring (16), goes through the middle hole of the block (26). Two pins (27a) and (27b) (pin 27a has two springs 28 linked to the base 21), goes through the top and bottom holes, respectively, of the block (26). While the ring (16) with the upper base (23) moves in a swivel-rock and vertical motion, the above mechanism gives free play in a vertical direction. This free-play functions as a cushioning effect.

F. Curvilinear-Circular Motion

The cam (4) is placed on the stand (22). The slotted block (2), and slide (3), are located above the cam (4) to permit their rotation. The left side of the slide (3) (relative to the FIGS. 1 or 5) is linked to the crankshaft (9), and the other side of the slide (3) has a roller (5), which is seated in the groove (4g) of the cam (4). When the main-shaft (1) with the slot (2) turns, it will bring along the roller (5) which extends from the slide (3) rolling in the cam (4). This action allows the crankshaft (9), which is on the left side of the slide (3) to turn around the main-shaft (1) as designed producing a curvilinear-circular motion.

G. Aligned Movement Frame

This frame consists of two parallel bars (8a, 8b), track (7), block (6), and a frame support (18) (As shown in FIGS. 5 and 1). These parts are placed or mounted on floor base or support (B). Floor base (B) generally comprises legs (30) mounted to stand (22). Floor base (B) should rest on a comparatively level or flat floor or other surface sufficient to hold the present invention. The block (6) can only slide left and right (relative to the figure) in the slot (7), and the slot (7) can only move up and down on the two parallel bars (8a, 8b), thus causing the block (6) to keep an aligned movement. While the chair moves, this type of frame saves space as it covers the stand (22). It also allows space to place the mechanisms that provide the curvilinear-circular motion.

H. The Block (6) and Crankshaft (9)

The block (6), is locked to the intermediate base (21). The intermediate base (21) and upper base (23) are linked together by the U-joint (16, 17, 19). One end of the crankshaft (9) is fixed to an end of slide (3) in such a way that there is little rotation of the crankshaft (9) about its vertical central axis. When the crankshaft (9) turns or is moved around the main-shaft (1), the following action happens: the crankshaft (9) drives the block (6) into an aligned movement. The upper base (23), the intermediate plate or base (21), the U-joint (16, 17, 19), and the two sets of cams (10a, 10b, 10c and 20a, 20b, 20c) also have an aligned movement, because they are linked together with block (6). In the meantime, the crankshaft (9) that goes through the center hole of block (6) can move freely within it. There is also a relative turning (see explanation above) between the crankshaft (9) and the block (6) while the main-shaft (1) turns. This relative turning causes the rollers (12a, 12b, 12c and 15a, 15b, 15c), (which are linked to the crankshaft (9) by arms (11a, 11b, 11c)), to roll on the surface of their relative cams (10a, 10b 10c and 20a, 20b, 20c)(The cams (10a, 10b, 10c) linked to block 6, by the U-joint and intermediate base 21). All of these actions result in swivel-rock and vertical motions.

I. The Relative Movement Between The Cams (10a, 10b, 10c and 20a, 20b, 20c) and arms (11a, 11b, 11c)

Figure 9:
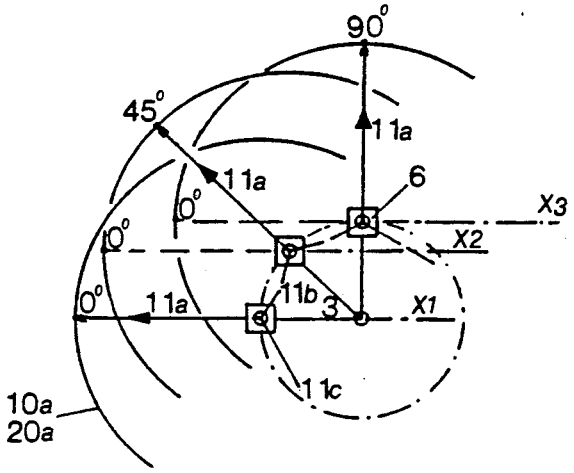
FIG. 9 is a depiction of the aligned movement of block (6) and relative movement between the cams (10*a*, 20*a*) and arms (11*a*).

As FIG. 9 shows, the line of the arm (11a) and the extension line of the slide (3), are aligned at all time, while they are moving. Assume the line on arm (11a) starts a clockwise turning at 0° on the cam (10a) and cam (20a). When the crankshaft (9), turns from 0° to 45°, it drives the block (6) with the cam (10a) and cam (20a), to turn as an aligned movement from the line $x_1$ to the line $x_2$. Also, the line on arm (11a) turns around the block (6) from the starting point 0° to 45° on the cam (10a) and (20a). In other words, there is a relative turning between the arm (11a) and the cam (10a) and (20a). This is because there is a relative turning point between the crankshaft (9) and the block (6), while the main-shaft is turning. Again, when the block (6) moves (aligned movement) from the line ($x_2$) to the line ($x_3$), the arm (11a) turns around the block (6) from 45° to 90° on the cam (10a). This action also similarly happens to the other two arms (11b, 11c) and cams (10b, 10c, 20b, 20c).

J. The chair's movement can be adjusted for the user's tastes by changing different sets of cams (4), (10a, 10b, 10c) and (20a, 20b, 20c).

K. The user's feet can be either on the ground or on the chair foot rest (58). Optionally, flexible skirts (52 and 54) can hide the mechanical parts of the hula chair (H) from view.

L. The chair can also include an optional moving back-support (23b) that inclines back and forth (a few extra mechanical parts will be added) with arms (23a) extending from platforms or chair base (23).

M. The seat (S) can alternatively provide a base or support other than a typical chair. For example, the seat (S) may provide an excellent base for a mixing device or container to mix ingredients with its movement in all three axes.

The seat (S) can have adjustable arm heights, and back angles and heights. Also, the height of the seat above the surface can similarly be adjustable.

N. Optionally, the present invention may have only one solid crankshaft. If the cam (4) traces a circle, there is no need for the slide (3) and slotted block (2). Then a single solid crankshaft having a similar configuration or bend can replace the main-shaft (1), the slotted block (2) and slide (3) that are mounted perpendicular to the main-shaft (1), and the crankshaft (9).

The foregoing disclosure and description of the invention are illustrative and explanatory thereof, and various changes in the size, shape and materials, as well as in the details of the illustrated construction may be made without departing from the spirit of the invention.

We claim:

1. An exercising device of the type that includes a chair having a seat portion and a back portion, the invention comprising:

a base means for supporting the exercising device above a selected surface;

closed horizontal loop means for producing a controlled closed loop movement of an essentially perpendicular axis in a substantially horizontal plane;

vertically rising means for producing a controlled vertical movement;

rocking means for imparting a selected rocking movement to the seat;

first connecting means for mechanically coupling the closed loop means to the vertically rising means;

second connecting means for mechanically coupling the vertically rising means to the rocking means;

motor means for providing energy to drive the closed loop means through its travel;

whereby, activation of the motor means generates movement in the seat in essentially a horizontal plane, vertically, or a rocking motion, or any desired combination of the three movements.

2. The invention of claim 1, wherein the motor means comprises an electric motor.

3. The invention of claim 1, wherein the motor is connected to the closed horizontal loop means by a connecting link comprising two parts relatively slidable with respect to each other.

4. The invention of claim 1, wherein the second connecting means is provided with cushioning means to absorb shocks due to change in direction of movement of the seat portion.

5. The invention of claim 1, further including two sets of essentially concentric cams having a selected height; an upper set of the cams is mounted to the bottom of the seat portion; and, a lower set of the cams is affixed to an intermediate plate connected to the first connecting means.

6. The invention of claim 5, wherein the chair is suspended by a universal joint mounted to the intermediate plate.

7. The invention of claim 1 in which the closed loop movement essentially is circular, wherein the closed horizonal loop means, the vertically rising means, and the first connecting means comprise a single crankshaft.

8. The invention of claim 1 wherein the orientation of the seat portion remains essentially aligned facing a desired direction.

9. The invention of claim 1, wherein there is relative movement about the perpendicular axis of the closed horizontal loop means with respect to a fixed point on the rocking means.

10. A chair comprising:

a base support portion;

an upper structure including:

a body carrying seat portion;

arm supports mounted above and at the sides of the seat portion; and, a back extending upwardly from the seat portion;

closed horizontal loop means for producing a controlled closed loop movement of an essentially perpendicular axis in a substantially horizontal plane;

vertically rising means for producing a controlled vertical movement;

rocking means for imparting a selected rocking movement to the seat;

first connecting means for mechanically coupling the closed loop means to the vertically rising means;

second connecting means for mechanically coupling the vertically rising means to the rocking means;

motor means for providing energy to drive the closed loop means through its travel;

whereby, activation of the motor means generates movement in the seat in essentially a horizontal plane, vertically, or a rocking motion, or any desired combination of the three movements.

11. The invention of claim 10, wherein the motor means comprises an electric motor.

12. The invention of claim 10, wherein the motor is connected to the closed horizontal loop means by a connecting link comprising two parts relatively slidable with respect to each other.

13. The invention of claim 10, wherein the second connecting means is provided with cushioning means to absorb shocks due to change in direction of movement of the upper structure.

14. The invention of claim 10, further including two sets of essentially concentric cams having a selected height; an upper set of the cams is mounted to the bottom of the seat portion; and, a lower set of the cams is affixed to an intermediate plate connected to the first connecting means.

15. The invention of claim 14, wherein the upper structure is suspended by a universal joint mounted to the intermediate plate.

16. The invention of claim 10 in which the closed loop movement essentially is circular, wherein the closed horizonal loop means, the vertically rising means, and the first connecting means comprise a single crankshaft.

17. The invention of claim 10 wherein the orientation of the upper structure remains essentially aligned facing a desired direction.

18. The invention of claim 10, wherein there is relative movement about the perpendicular axis of the closed horizontal loop means with respect to a fixed point on the rocking means.

19. A machine for providing a platform base movable in three dimensions comprising:

a base support portion;

an upper structure adapted to mount selected devices;

closed horizontal loop means for producing a controlled closed loop movement of an essentially perpendicular axis in a substantially horizontal plane;

vertically rising means for producing a controlled vertical movement;

rocking means for imparting a selected rocking movement to the upper structure;

first connecting means for mechanically coupling the closed loop means to the vertically rising means;

second connecting means for mechanically coupling the vertically rising means to the rocking means;

motor means for providing energy to drive the closed loop means through its travel;

whereby, activation of the motor means generates movement in the upper structure in essentially a horizontal plane, vertically, or a rocking motion, or any desired combination of the three movements.

20. The invention of claim 19, wherein the motor means comprises an electric motor.

21. The invention of claim 19, wherein the motor is connected to the closed horizontal loop means by a connecting link comprising two parts relatively slidable with respect to each other.

22. The invention of claim 19, wherein the second connecting means is provided with cushioning means to absorb shocks due to change in direction of movement of the upper structure.

23. The invention of claim 19, further including two sets of essentially concentric cams having a selected height; an upper set of the cams is mounted to the bottom of the seat portion; and, a lower set of the cams is affixed to an intermediate plate connected to the first connecting means.

24. The invention of claim 23, wherein the upper structure is suspended by a universal joint mounted to the intermediate plate.

25. The invention of claim 24, wherein the universal joint is provided with cushioning means to absorb shocks due to change in direction of movement of the upper structure

26. The invention of claim 19 in which the closed loop movement essentially is circular, wherein the closed horizonal loop means, the vertically rising means, and the first connecting means comprise a single crankshaft.

27. The invention of claim 19 wherein the orientation of the upper structure remains essentially aligned facing a desired direction.

28. The invention of claim 19, wherein there is relative movement about the perpendicular axis of the closed horizontal loop means with respect to a fixed point on the rocking means.

* * * * *